US007726513B2

(12) United States Patent
Schlaupitz et al.

(10) Patent No.: US 7,726,513 B2
(45) Date of Patent: Jun. 1, 2010

(54) OPTIONAL HANGING DISPENSER

(75) Inventors: Robert Samuel Schlaupitz, New London, WI (US); Herb Flores Velazquez, Neenah, WI (US); Meara Catherine Kelley, Woodstock, GA (US); David James Wilks, Appleton, WI (US); David N. Woods, Madison, WI (US); Scott G. Manke, Sun Prairie, WI (US); Zachary Robert Kowalski, Marysville, WA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 239 days.

(21) Appl. No.: 11/513,738

(22) Filed: Aug. 31, 2006

(65) Prior Publication Data

US 2008/0067185 A1 Mar. 20, 2008

(51) Int. Cl.
*A47K 10/24* (2006.01)

(52) U.S. Cl. ..... 221/45

(58) Field of Classification Search ..... 248/58, 248/59, 60, 215, 229.16, 230.7, 231.81, 301, 248/317, 318, 322, 323, 327, 339, 340, 505, 248/690, 692, 69, 905; 206/233, 494, 806; 221/27, 28, 29, 34, 38, 40, 45, 46, 49, 83, 221/99, 122, 152, 154, 156, 185, 186, 192, 221/197, 199, 242, 262, 282, 283, 284, 285, 221/286; 24/265 H, 265 R, 265 EC, 265 A, 24/298, 300; 211/113, 118, 119.09, 195
See application file for complete search history.

(56) References Cited

U.S. PATENT DOCUMENTS 2,025,732 A 12/1935 Dodelin
2,685,365 A 8/1954 Sieven (Continued)

FOREIGN PATENT DOCUMENTS

DE 297 19 026 U1 3/1998

(Continued)

OTHER PUBLICATIONS

American Society for Testing Materials (ASTM) Designation: B 395-95, "Standard Specification for U-Bend Seamless Copper and Copper Alloy Heat Exchanger and Condenser Tubes," pp. 535-543, published Oct. 1995.

(Continued)

*Primary Examiner*—Gene Crawford
*Assistant Examiner*—Kelvin L Randall, Jr.
(74) *Attorney, Agent, or Firm*—R. Joseph Foster, III; Scott A. Baum

(57) ABSTRACT

A product for hanging from a paper roll holder having at least one arm including a sheet-material dispenser and at least one hanging member for attaching the sheet-material dispenser to the at least one arm. In one embodiment of the invention, the second end of the hanging member that is removably attachable to the arm of the paper roll holder included an elastomeric strap for wrapping about both arms of a toilet paper holder. Since the sheet-material dispenser is attached to the arms of the paper roll holder, it is not necessary to remove the sheet-material dispenser when removing the spindle of the paper roll holder to change the paper roll.

17 Claims, 9 Drawing Sheets

U.S. PATENT DOCUMENTS

| | | | | | |
|---|---|---|---|---|---|
| 3,086,724 | A | | 4/1963 | Powell | |
| 3,251,571 | A | * | 5/1966 | Ernest | 248/693 |
| 3,297,265 | A | | 1/1967 | Turro | |
| 3,794,253 | A | | 2/1974 | Megdall | |
| 3,824,953 | A | | 7/1974 | Boone | |
| 3,830,198 | A | | 8/1974 | Boone | |
| 3,837,595 | A | | 9/1974 | Boone | |
| 3,943,859 | A | | 3/1976 | Boone | |
| 3,979,094 | A | * | 9/1976 | DeWitt | 248/60 |
| 4,004,687 | A | | 1/1977 | Boone | |
| 4,106,616 | A | | 8/1978 | Boone | |
| 4,106,617 | A | | 8/1978 | Boone | |
| D252,842 | S | | 9/1979 | McKee | |
| 4,235,333 | A | | 11/1980 | Boone | |
| 4,235,350 | A | * | 11/1980 | Valentino | 220/495.1 |
| D259,682 | S | | 6/1981 | Standing | |
| 4,309,019 | A | * | 1/1982 | Bloom | 248/610 |
| 4,385,733 | A | | 5/1983 | O'Keefe | |
| 4,427,159 | A | | 1/1984 | Miller et al. | |
| 4,532,833 | A | * | 8/1985 | Downs | 81/64 |
| 4,834,316 | A | | 5/1989 | DeLorean | |
| 4,978,095 | A | * | 12/1990 | Phillips | 248/312 |
| 5,012,986 | A | | 5/1991 | Needle | |
| D318,770 | S | | 8/1991 | Grisel | |
| 5,192,044 | A | | 3/1993 | Baskin | |
| 5,255,800 | A | | 10/1993 | Kelly | |
| 5,311,986 | A | | 5/1994 | Putz | |
| D356,225 | S | * | 3/1995 | Coggins et al. | D6/520 |
| 5,439,521 | A | | 8/1995 | Rao | |
| 5,494,250 | A | | 2/1996 | Chen | |
| 5,605,250 | A | | 2/1997 | Meiron et al. | |
| 5,618,008 | A | | 4/1997 | Dearwester et al. | |
| 5,692,639 | A | * | 12/1997 | Lahaussois et al. | 221/45 |
| D393,387 | S | | 4/1998 | Gregor et al. | |
| D393,389 | S | | 4/1998 | Thurston et al. | |
| D406,481 | S | | 3/1999 | Conrado | |
| 5,897,074 | A | * | 4/1999 | Marino | 242/594.1 |
| 5,980,931 | A | | 11/1999 | Fowler et al. | |
| D417,351 | S | | 12/1999 | Scavuzzo | |
| 6,047,920 | A | | 4/2000 | Dearwester et al. | |
| 6,121,165 | A | | 9/2000 | Mackey et al. | |
| D452,094 | S | * | 12/2001 | Akin | D6/515 |
| 6,378,800 | B1 | | 4/2002 | Apichom | |
| 6,382,552 | B1 | | 5/2002 | Paul et al. | |
| 6,446,808 | B1 | | 9/2002 | Paul et al. | |
| 6,460,799 | B1 | | 10/2002 | Ryan | |
| 6,497,345 | B1 | | 12/2002 | Wilker et al. | |
| 6,523,690 | B1 | | 2/2003 | Buck et al. | |
| 6,568,625 | B2 | * | 5/2003 | Faulks et al. | 242/596 |
| 6,592,004 | B2 | | 7/2003 | Huang et al. | |
| D481,393 | S | | 10/2003 | Alo et al. | |
| D481,893 | S | | 11/2003 | Walther et al. | |
| 6,766,919 | B2 | | 7/2004 | Huang et al. | |
| 6,929,148 | B2 | * | 8/2005 | Haddad et al. | 221/45 |
| 7,147,129 | B1 | * | 12/2006 | Menefield | 221/283 |
| 2002/0139811 | A1 | * | 10/2002 | Tramontina et al. | 221/197 |
| 2005/0283980 | A1 | * | 12/2005 | Bathard et al. | 30/131 |
| 2006/0037230 | A2 | * | 2/2006 | Oelerich et al. | 43/42.24 |
| 2007/0166561 | A1 | * | 7/2007 | Ziegler et al. | 428/480 |

FOREIGN PATENT DOCUMENTS

| | | | |
|---|---|---|---|
| EP | 0 122 809 | A1 | 10/1984 |
| EP | 1 352 601 | A2 | 10/2003 |
| GB | 2 270 901 | A | 3/1994 |
| GB | 2 357 076 | A | 6/2001 |
| JP | 2000-085782 | A | 3/2000 |
| JP | 2003-070679 | A | 3/2003 |
| JP | 2003-072765 | A | 3/2003 |
| JP | 2003-072866 | A | 3/2003 |
| WO | WO 98/08763 | A1 | 3/1998 |
| WO | WO 01/89937 | A2 | 11/2001 |

OTHER PUBLICATIONS

American Society for Testing Materials (ASTM) Designation: D 412-98a, "Standard Test Methods for Vulcanized Rubber and Thermoplastic Elastomers—Tension," pp. 43-55, published Aug. 1998.

American Society for Testing Materials (ASTM) Designation: D 792-98, "Standard Test Methods for Density and Specific Gravity (Relative Density) of Plastics by Displacement," pp. 159-163, published Nov. 1998.

American Society for Testing Materials (ASTM) Designation: D1894-01, "Standard Test Method for Static and Kinetic Coefficients of Friction of Plastic Film and Sheeting," pp. 16, published Jun. 2001.

American Society for Testing Materials (ASTM) Designation: D2240-97, "Standard Test Method for Rubber Property—Durometer Hardness," pp. 400-403, published Mar. 1997.

American Society for Testing Materials (ASTM) Designation: D6125-97, "Standard Test Method for Bending Resistance of Paper and Paperboard (Gurley Type Tester)," pp. 885-889, published Feb. 1998.

* cited by examiner

OPTIONAL HANGING DISPENSER

BACKGROUND

Increasingly, consumers are using wet wipe products in addition to dry bathroom tissue for personal hygiene in the bathroom. However, most toilet paper roll holders are designed only to hold a single roll of dry bathroom tissue. The existing toilet paper roll holders are not designed for supporting a wet wipes dispenser. This can reduce or hinder using wet wipes within the bathroom if they cannot otherwise be located close to the toilet for easy use.

Various devices have been configured to allow for an additional wet wipe dispenser to mount with the existing designs for toilet paper roll holders. These devices usually take one of two approaches. One approach is to replace the existing toilet paper spindle in the toilet paper roll holder and then insert a custom dispenser that mounts with the existing holes in the toilet paper roll holder that the spindle's ends are inserted into. The custom dispenser usually has provisions for holding a dry tissue roll and a compartment for dispensing wet wipes. A drawback to this approach is that often the custom designed dispenser is large and/or unsightly. Many people do not like the look of the custom dispensers in the bathroom. Furthermore, the custom dispensers can be expensive. People who are unsure that they will like or use the custom dispenser often will not try the product due to the higher initial cost.

A second approach is to hang the wet wipes dispenser from the existing toilet paper holder by hooking the dispenser to the spindle. A problem with this approach is that refilling the toilet paper roll holder with a new tissue roll is cumbersome since you also have to remove and replace a second dispenser each time the toilet paper roll needs changing. Many consumers do not wish to bother with this annoyance and avoid the wet wipe dispensers with hooks that attach to the spindle. A further problem with using hooks to hang the wet wipes dispenser from the toilet paper spindle is that the hooks are permanently attached to the wet wipes dispenser such that the dispenser can only be used by hanging it from the toilet paper spindle.

Consumers who use wet wipes tend to be bifurcated between those desiring to place the wet wipes dispenser near the dry tissue roll and those preferring to place the wet wipes dispenser out of sight or hidden since they would feel embarrassed if other people knew they were using the product. As such, it is desirable that a wet wipes dispenser can be optionally located near the dry toilet paper roll, or suitable for using on flat surfaces instead of hanging, or convenient to hold and dispense the wet wipes.

In view of the above, a need exists for a dispenser that can be located or hung from a paper roll holder that is more convenient to use. A need also exists for a dispenser than can be used either in a hanging mode, or by placing on a flat surface.

SUMMARY

The inventors have discovered that by designing an auxiliary sheet-material dispenser that can be attached to the arms of a paper roll holder instead of the spindle, it is much easier to change the paper roll. Furthermore, if the hanging member of the sheet-material dispenser is removably attachable to the sheet-material dispenser, the sheet-material dispenser can be used in other locations with the hanging member removed.

Hence, in one aspect, the invention resides in a product for hanging from a paper roll holder having at least one arm, the product including a sheet-material dispenser and at least one hanging member for attaching the sheet-material dispenser to the at least one arm, and the hanging member forming a loop about the at least one arm to hold the sheet-material dispenser.

BRIEF DESCRIPTION OF THE DRAWINGS

The above aspects and other features, aspects, and advantages of the present invention will become better understood with regard to the following description, appended claims, and accompanying drawings in which:

Figure 1:
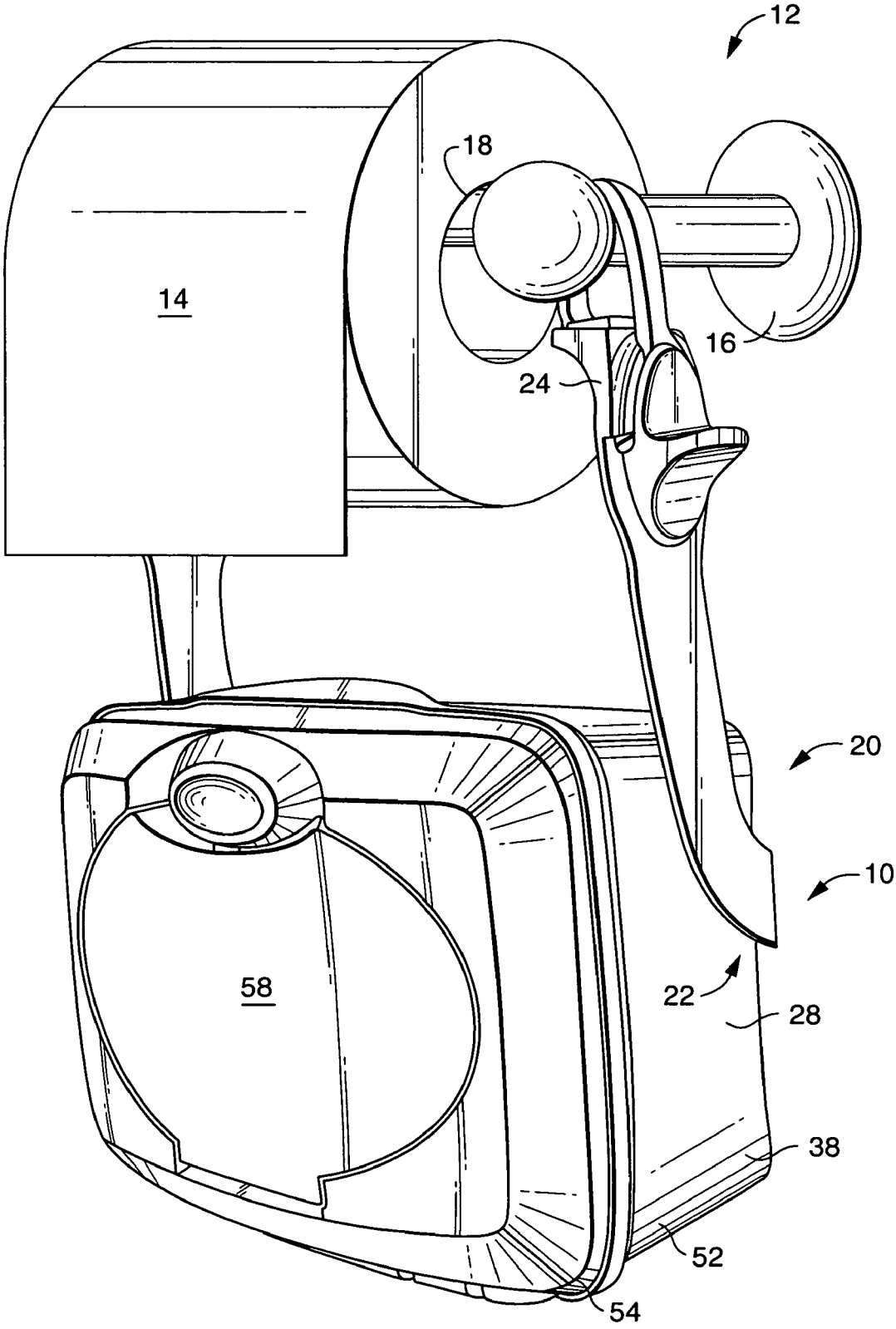
FIG. 1 is a perspective view illustrating the sheet-material dispenser of the present invention hanging from a dry paper roll holder.

Repeated use of reference characters in the specification and drawings is intended to represent the same or analogous features or elements of the invention in different embodiments.

Definitions

As used herein, forms of the words "comprise", "have", and "include" are legally equivalent and open-ended. Therefore, additional non-recited elements, functions, steps or limitations may be present in addition to the recited elements, functions, steps, or limitations.

As used herein, "sheet-material" is a flexible substrate, which is useful for household chores, cleaning, personal care, health care, food wrapping, and cosmetic application or removal. Non-limiting examples of suitable substrates for use with the sheet-material dispenser include nonwoven substrates; woven substrates; hydro-entangled substrates; air-entangled substrates; paper substrates comprising cellulose such as tissue paper, toilet paper, or paper towels; waxed paper substrates; coform substrates comprising cellulose fibers and polymer fibers; wet substrates such as wet wipes, moist cleaning wipes, moist toilet paper wipes, and baby wipes; film or plastic substrates such as those used to wrap food; shop towels; and metal substrates such as aluminum foil. Furthermore, laminated or plied together substrates of two or more layers of any of the preceding substrates are also suitable.

As used herein, "wet sheet-material" includes substrates that are either wet or pre-moistened by an appropriate liquid, partially moistened by an appropriate liquid, or substrates that are initially dry but intended to be moistened prior to use by placing the substrate into an appropriate liquid such as water or a solvent. Non-limiting examples of suitable wet substrates include a substantially dry substrate (less than 10% by weight of water) containing lathering surfactants and conditioning agents either impregnated into or applied to the substrate such that wetting of the substrate with water prior to use yields a personal cleansing product. Such substrates are disclosed in U.S. Pat. No. 5,980,931 entitled Cleansing Products Having A Substantially Dry Substrate, issued to Fowler et al. on Nov.

9, 1999. Other suitable wet sheet-materials can have encapsulated ingredients such that the capsules rupture during dispensing or use. Other suitable wet sheet-materials include dry substrates that deliver liquid when subjected to in-use shear and compressive forces. Such substrates are disclosed in U.S. Pat. No. 6,121,165 entitled Wet-Like Cleaning Articles, issued to Mackay et al. on Sep. 19, 2000.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

Figure 2:
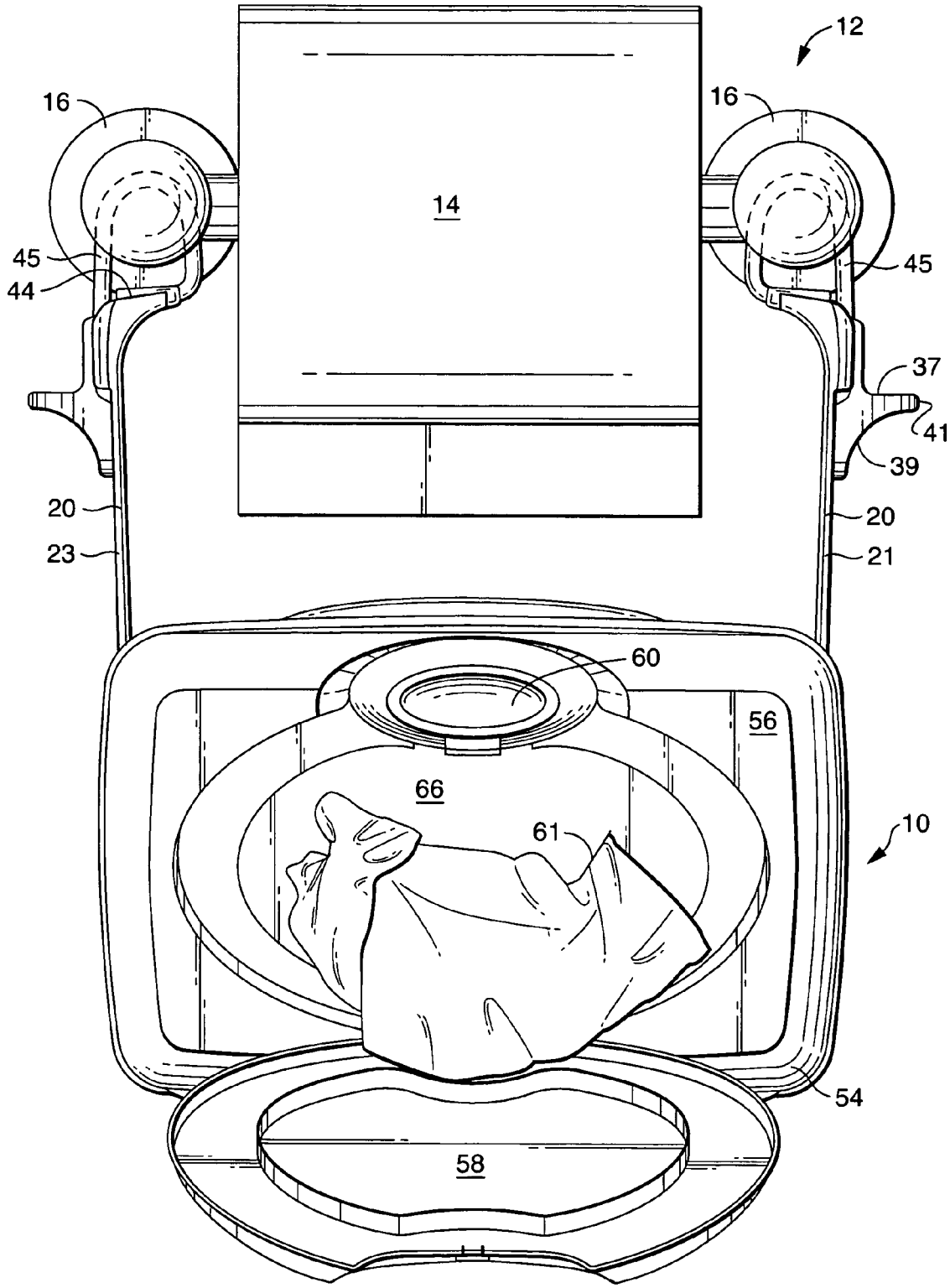
FIG. 2 is a front view illustrating the sheet-material dispenser in use.
Figure 3:
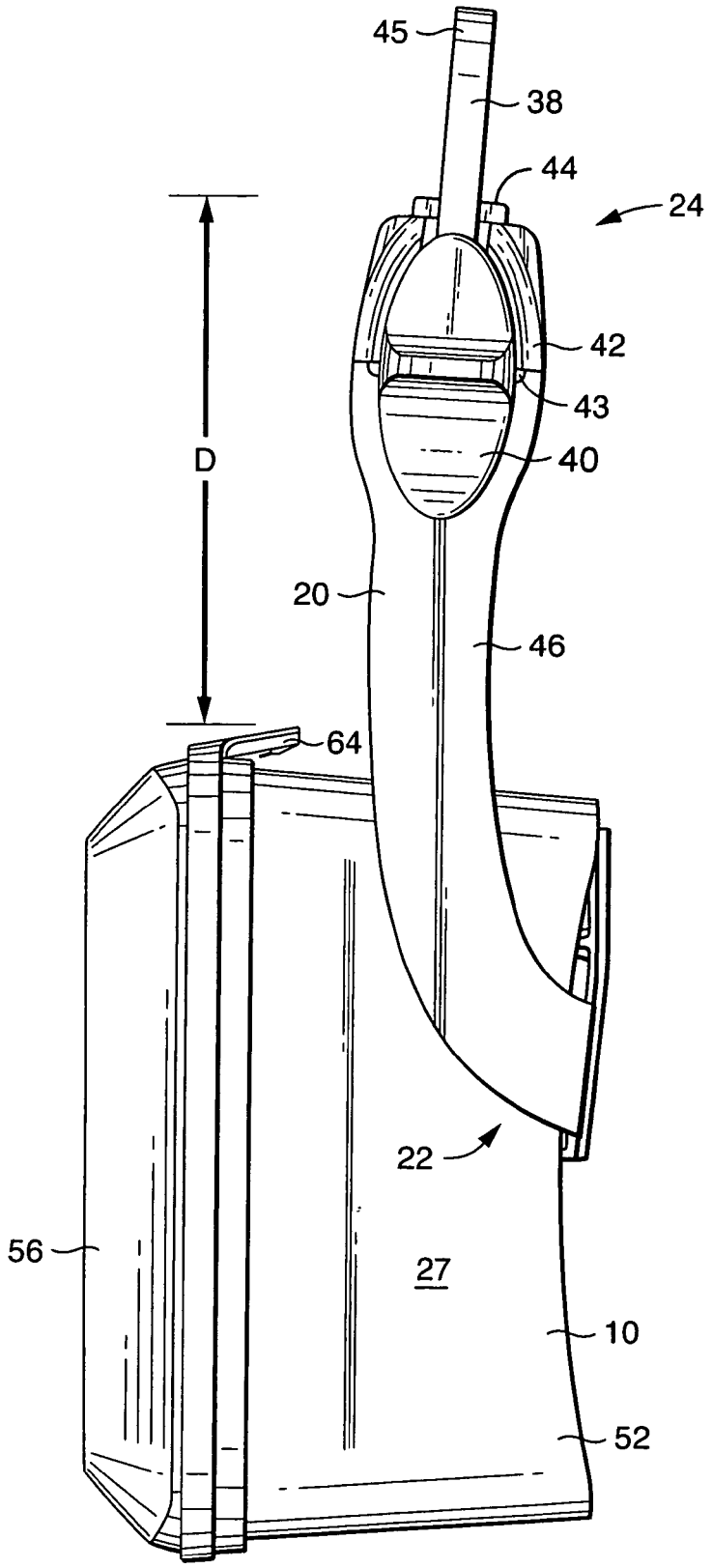
FIG. 3 is a side view illustrating the hanging member attached to the sheet-material dispenser.

Referring now to FIGS. 1, 2, and 3, one embodiment of the invention is shown. An auxiliary sheet-material dispenser 10 is hung from a paper roll holder 12 supporting a paper roll 14. The paper roll holder 12 includes at least one arm 16, but most often includes a pair of arms 16 and a removable spindle 18. Various paper roll holders exist and they may be recessed partially into a wall, an integral assembly having a backing plate for mounting on a wall or other surface, separate posts as shown, or otherwise vary from the paper roll holder 12 illustrated in FIG. 1. As used herein, the "arms" of the paper roll holder 12 comprise the structure surrounding an aperture that the spindle 18 is inserted into and supported by that typically extend some distance away from the surface the paper roll holder is mounted to. The arms 16 may be round, rectangular, arcuate or other cross-sectional shapes. In other embodiments of the paper roll holder 12, the arms 16 may have a projection or stub shaft that is inserted into the core of the paper roll 14 thereby eliminating the spindle 18.

The sheet-material dispenser 10 can be hung beneath the paper roll 14 by at least one hanging member 20, but preferably a pair of hanging members 20 is used to support the sheet-material dispenser 10. The hanging members 20 include a first end 22 that is removably attachable to the sheet-material dispenser 10 and a second end 24 having a loop 45 that is removably attachable to the paper roll holder's arms 16. Since the sheet-material dispenser 10 is hung from the arms 16 of the paper roll holder 12, the tissue roll 14 and/or paper roll spindle 18 can be removed and replaced without having to relocate or move the sheet-material dispenser 10. This makes it much more convenient to change the paper roll 14 since the sheet-material dispenser 10 is not supported by the spindle 18.

Figure 4:
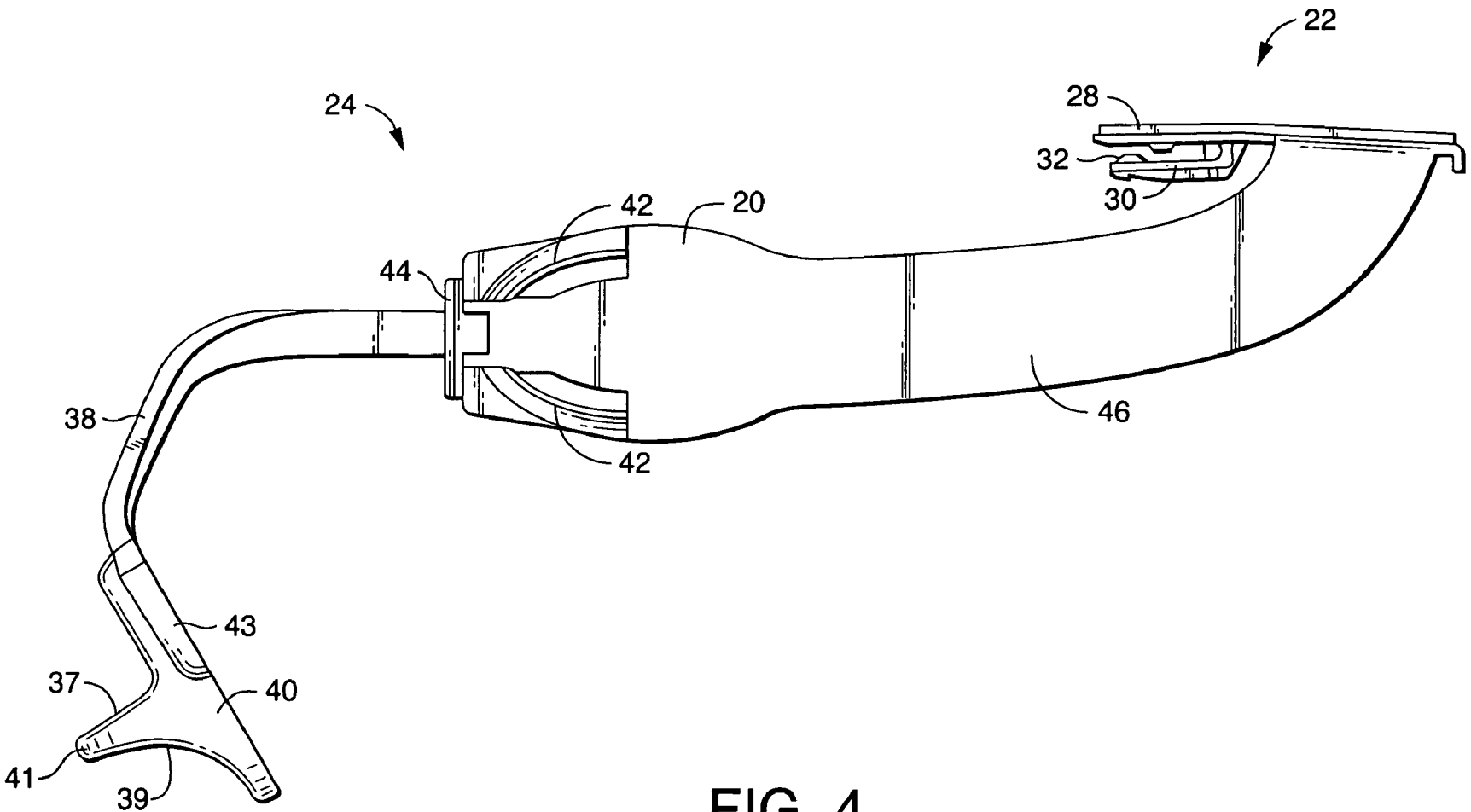
FIG. 4 is a side view of the hanging member.
Figure 5:
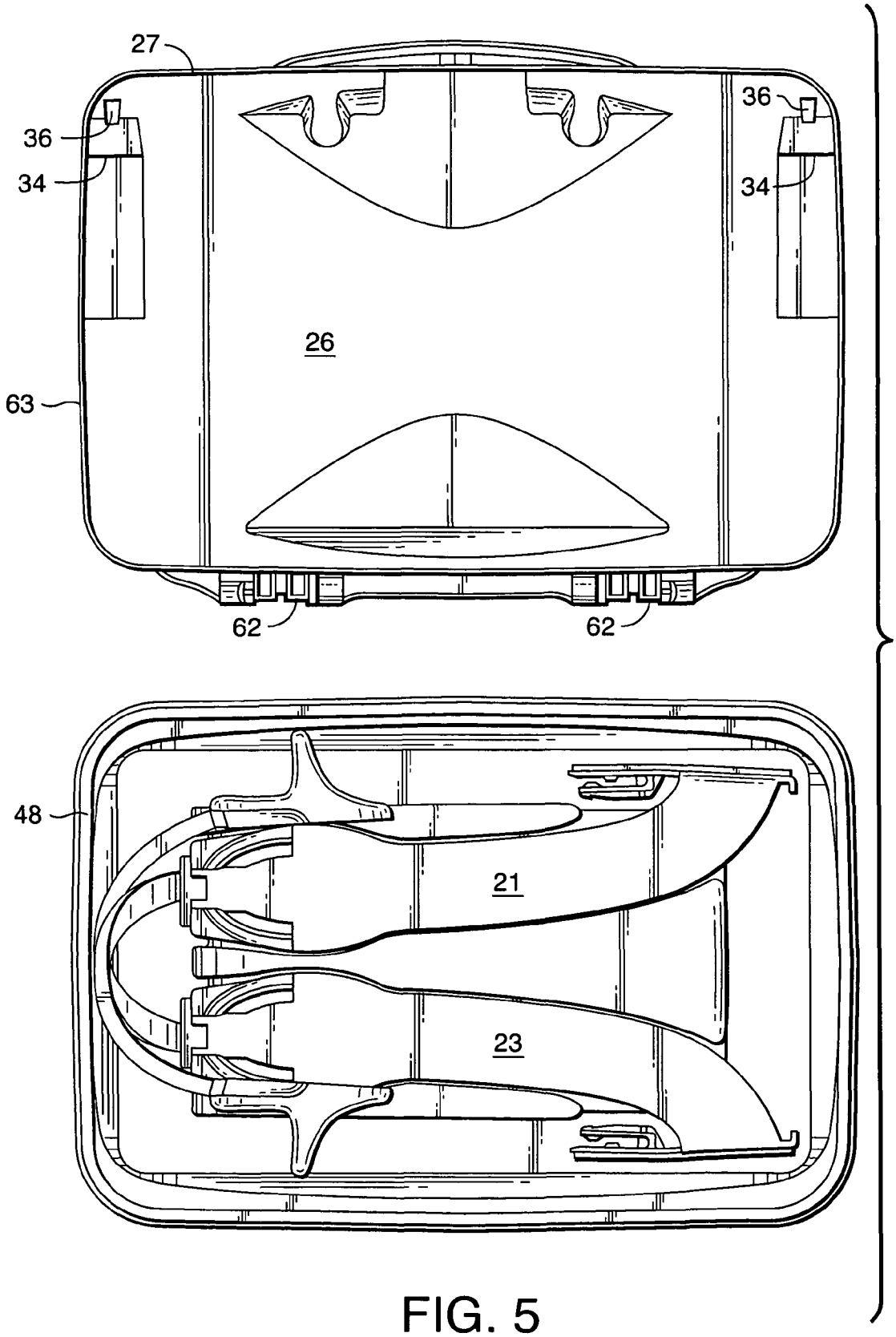
FIG. 5 is a bottom view illustrating the bottom of the sheet-material dispenser and a tray holding a pair of hanging members.

Referring now to FIGS. 3, 4, and 5, more details of the hanging member 20 are shown. Each hanging member 20 includes the first end 22 that is removably attachable to the sheet-material dispenser's bottom 26, and the second end 24 having a loop 45 that is removably attachable to the paper roll holder's arms 16. The first end 22 can further include a tongue 28 and a locking tab 30 that together form a U-shaped channel. The locking tab 30 includes a projection 32 near the distal end. The tongue 28 can be inserted into a slot 34 in the sheet-material dispenser's bottom 26 and advanced within the slot until the projection 32 on the locking tab 30 snaps into an aperture 36 in the bottom 26 near the end of the slot 34. The locking tab 30 and tongue 28 removably attaches the hanging member 20 to the sheet-material dispenser 10. Thus, the hanging member 20 can be securely attached to the sheet-material dispenser 10 if it is desired to hang the sheet-material dispenser. If it is no longer desired to hang the sheet-material dispenser 10, the locking tab 30 is flexible such that pulling on the hanging member 20 in the opposing direction of insertion will disengage the projection 32 from the aperture 36 allowing the tongue 28 to be slid out of the slot 34. Alternatively, the locking tab 30 can be pried upwards to disengage the projection 32 allowing the first end 22 to be slid out of engagement with the sheet-material dispenser's bottom 26.

The first end 22 of the hanging member 20 can be generally perpendicular to a body portion 46 of the hanging member in order to attach the hanging member to the sheet-material dispenser's bottom 26 while allowing a portion of the body portion 46 to rest adjacent a sidewall 27 of the sheet-material dispenser 10. As such, the hanging members can comprise a right-hand 21 and a left-hand 23 hanging member having the body portion 46 and the first end 22 formed such that when each hanging member is attached to the right and left sides of the sheet-material dispenser 10, a portion of the body portion 46 lies adjacent to the sheet-material dispenser's sidewall 27. The right-hand 21 and left-hand 23 hanging members are mirror images of each other. Alternatively, the hanging member 20 can be a universal hanging member such that it can attach to either side of the sheet-material dispenser 10 as shown in FIG. 8D.

Other methods of removably attaching the first end 22 of the hanging member 20 to the sheet-material dispenser 10 can be used. In addition to the specific tongue 28 and slot 34 described above, the tongue on the first end 22 can be oriented differently, and the slot can be located differently. For example, the slot 34 can extend into the sheet-material dispenser's interior such as a vertical slot extending towards the sheet-material dispenser's top that is located in the bottom of the sheet-material dispenser 10 for engaging a tongue 28 extending from the first end 22. Alternatively, the first end 22 can be attached with hook and loop material, non-permanent adhesive materials such as 3M Command® adhesive strips, mechanical fasteners such as screws, by using pins and apertures, or by a light press fit. Alternatively, the hanging member 20 can be integrally attached to the sheet-material dispenser 10 by using a living hinge such that when not in use, the hanging member can be folded out of the way such as being placed adjacent to the sidewall 27 of the sheet-material dispenser. The living hinge can be perforated or weak enough such that the hanging member 20 can be torn away or removed from the sheet-material dispenser 10 if it is not needed. Thus, in various embodiment of the invention, the hanging member 20 can be provided with a means for removably attaching the first end 22 to a sheet-material dispenser 10 as discussed above and illustrated in the Figures.

Additionally, the hanging member 20 can be provided with a ratcheting hinge or pivot between the body portion 46 and the first end 22 such that the entire sheet-material dispenser can be rotated either up or down relative to the paper roll 14 for improved access to the sheet-material and the dispensing opening. The hanging member 20 can be attached to the sheet-material dispenser's sidewall 27, bottom 26, or even a top 54 of the sheet-material dispenser 10 depending on the desired placement of the sheet-material dispenser in relation to the paper roll 14.

Referring now to the second end 24 of the hanging member 20, the second end can include an elastomeric strap 38, and a sliding button 40 having a grasping tab 41 that includes a thumb rest 37 and a finger rest 39 for grasping and pulling on the sliding button by the thumb and index finger of one's hand thereby stretching the elastomeric strap. A sliding button flange 43 on the sliding button 40 for insertion into a receiving channel 42, located on an outward facing surface of the body portion 46, secures the sliding button to the body portion after wrapping the elastomeric strap 38 about the arms 16. The elastomeric strap 38 is especially useful to securely wrap around the arms 16 of the paper roll holder 12, and to accommodate arms having vastly different geometric shapes and sizes. If desired, the thumb rest 37 can be relatively flat and the finger rest 39 can be concave.

The elastomeric strap 38 can tension the hanging member 20 to rest snuggly against the arms 16 such that an anti-rotation stop 44, such as a flat upper surface on the second end 24 of the hanging member 20 extending perpendicular to the body portion 46, can reduce or prevent the sheet-material dispenser 10 from swinging back and forth as the sheet-material dispenser is used. The flat upper surface of the anti-rotation stop 44 can reduce the rocking or swinging motion of the sheet-material dispenser 10 by bringing more surface area of the hanging member 20 into line contact with the arms 16. If desired, the anti-rotation stop 44 can include a groove or a channel for mating with arms 16 having a rounded contour instead of a flat surface. The upper surface of the anti-rotation stop 44 can also be an elastomeric or flexible material to further assist in preventing slipping or movement of the hanging member 20 in relation to the arms 16 owing to a higher coefficient of friction. Alternatively, the elastomeric strap 38 can form the loop 45 about the arms 16 while leaving a gap between the anti-rotation stop 44 and the arms.

To secure the sheet-material dispenser 10 to the paper roll holder 12, the elastomeric strap 38 and the sliding button 40 are wrapped about each arm 16, forming a loop 45 and then the sliding button 40 is inserted into the receiving channel 42, engaging the sliding button flange 43 with the receiving channel. In this manner, the sheet-material dispenser 10 can be easily and securely attached to the paper roll holder 12, but readily removed by advancing the sliding button 40 out of the receiving flange 42 and unwrapping the elastomeric strap 38 from around the arms 16.

The hanging member 20 is sufficiently long from the first end 22 to the second 24 and attached to the sheet-material dispenser in such a manner that the sheet-material dispenser 10 will not interfere with a large diameter paper roll 14. Desirably, a clearance of about 1 inch or greater is provided between the sheet-material dispenser's sidewall 27 and a full size paper roll's lower surface. As such, the second end 24 and/or anti-rotation stop 44 should extend a distance, D, of approximately 3-4 inches above the sidewall 27 of the sheet-material dispenser 10 to ensure that the sheet-material dispenser 10 does not touch a typical toilet paper roll. Other diameter paper rolls, such as paper towels or shop towels may require a different distance depending on the roll's diameter when first placed into the paper roll holder 12.

Desirably, the second end 24 is offset from the first end 22 by making the body portion 46 of the hanging member 20 J-shaped. The J-shaped body portion can serve to hold the sheet-material dispenser 10 away from a wall that the paper roll holder 12 is mounted on to prevent scratching, damaging, or banging on the wall by the sheet-material dispenser during use. Alternatively, the offset can be used to hold the sheet-material dispenser against the wall to minimize swinging. The offset distance between the center-line of the elastomeric strap 38 and the first end 22 removably attached to the sheet-material dispenser's bottom 26 can be adjusted as necessary to either increase the distance between the wall and the sheet-material dispenser or to decrease it.

The elastomeric strap 38 can be made of a suitable material having the ability to stretch to at least 1.25 times its original length, such as two, three, or four times its original length, and return to within about 1.1 times its original length or less when held extended for 1 minute. One suitable elastomeric material is a thermoplastic elastomer (TPE) stryrenic block copolymer compound known as DYNAFLEX G translucent series G6730, produced by GLS Corporation, having an office in McHenry, Ill. Such a material has a percent elongation as measured by ASTM method D412, Die C of 530%, a 100% Modulus as measured by ASTM method D412, Die C of 110 psi, a hardness of 30 Shore A as measured by ASTM method D2240, 10 second delay, a coefficient of friction (COF) of 2.3 as measured by ASTM method D-1894, and a tear strength as measured by ASTM method D142, Die C of 80 pli. Desirably, the TPE material has a value for the 100% modulus that is less than the value for its elongation %; more desirably the TPE material has a value for the 100% modulus that is less than ½ the value for its elongation % to improve its stretchiness. Desirably, the TPE material has high tear strength to prevent ripping while under tension such as from about 40 pli to about 300 pli. Other suitable elastomeric materials can include EPDM rubber, silicones, and polyurethanes.

The length, L, of the elastomeric strap 38 as illustrated in FIG. 8D depends on the modulus of the material, the cross-sectional area of the elastomeric strap, and the circumference of the arms 16 of the paper roll holder 12. In general, the length, L, of the elastomeric strap will be between about 1 to about 3 inches, such as about 1.5 to about 2.5 inches for use with a toilet paper roll holder. The length of elastomeric strap 38 can be selected such that the elastomeric strap is under tension when wrapped about the arms 16, thereby holding the anti-rotation stop 44 firmly against the arm, or to be relaxed without being under tension, leaving a gap between the anti-rotation stop 44 and the arm. The width of the elastomeric strap 38 or a flexible strap 35, W, can vary depending on how far out the arms 16 of the paper roll holder 12 extend from the support surface. In general, the width, W, of the strap will be less than about 1 inch, such as less than about 0.5 inch, or less than about 0.375 inch. In particular, for a hanging member 20 that can be used on both recessed and non-recessed paper roll holders, a strap width of about 0.375 inches or less is desirable. Preferably, the cross-sectional area of the strap is square, rectangular, or having at least one flat side as opposed to uniformly round. A square or rectangular strap is less likely to twist or roll with regard to the arms 16 of the paper roll holder 12; especially, if the arms 16 are tapered.

Desirably, the elastomeric strap 38 or flexible strap 35 is formed from a material having a higher coefficient of friction (COF) such that the elastomeric strap is restrained from sliding or moving about the arms 16 of the paper roll holder 12 when in use. In various embodiments of the invention, the COF of the elastomeric strap 38 or of the flexible strap 35, as measured by ASTM method D-1894, can be between about 0.2 to about 3.5, or between about 1 to about 3.5, or between about 2 to about 3.5.

Figure 8C:
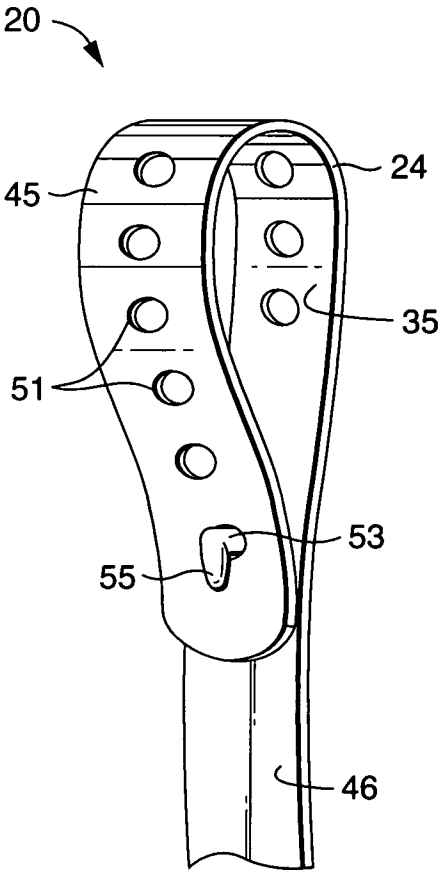
FIGS. 8A-8E illustrates alternative hanging members.
Figure 8B:
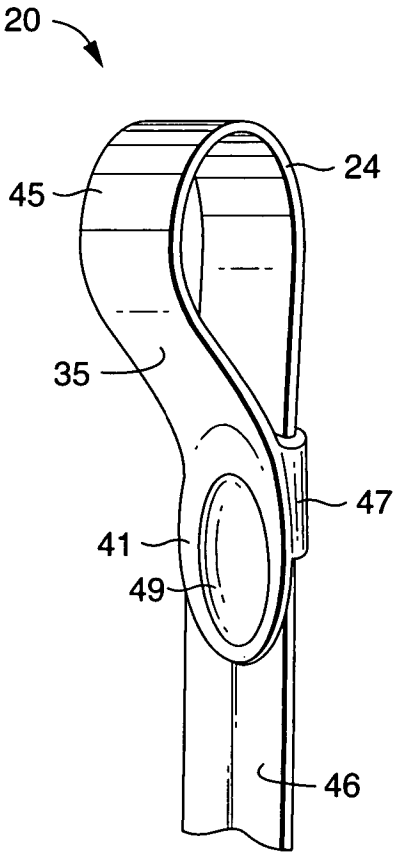
Figure 8A:
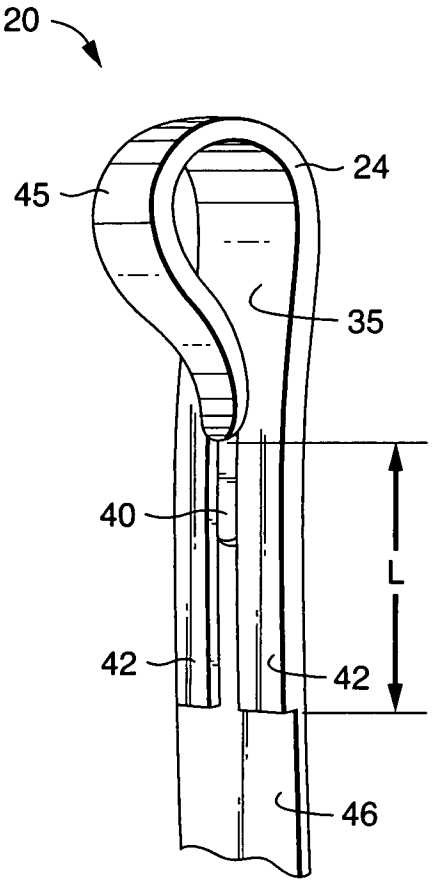
Figure 8D:
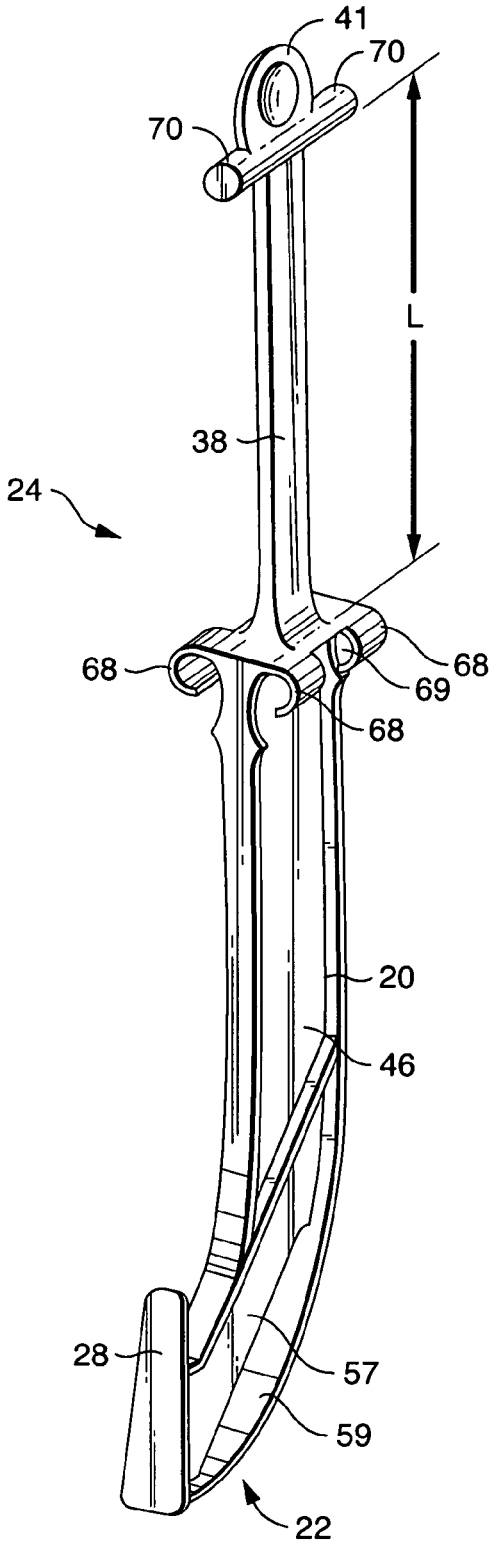

Referring now to FIGS. 8A-8E, different embodiments for the hanging member 20 are illustrated. In FIGS. 8A, B, C, and E, only the second end 24 is illustrated. The first end of these embodiments can be similar to that illustrated for FIG. 4 or the hanging member 20 can otherwise be attached to the sheet-material dispenser 10. In FIGS. 8A, B, C, and E, different methods of adjusting the conference of the loop 45 at the second end 24 are illustrated. As such, the strap at the second end 24 does not necessarily need to be an elastomeric material that stretches and needs to only be a flexible material that can be wrapped around the arms 16 of the paper roll holder 12.

Referring now to FIG. 8A, the second end 24 includes a sliding button 40 attached to a flexible strap 35 that extends from the body portion 46 of the hanging member 20 and engages with a receiving channel 42 located on the body portion. The second end 24 tapers from the receiving channel 42 to the sliding button 40 as shown. The receiving channel is relatively long, such as about 1 to about 5 inches, or about 1 to about 3 inches in length, in order to vary the circumference of the loop 45 formed when the sliding button 40 is inserted into the receiving channel 42, enabling the hanging member 20 to fit differently sized paper roll holder arms 16.

Referring now to FIG. 8B, the second end 24 includes a sleeve 47 and a tab 41 attached to a flexible strap 35 of the hanging member 20 at the second end 24 for adjusting the circumference of the loop 45. The tab can include a thumb depression 49 for improved grasping. The body portion 46 of the hanging member 20 is passed through the sleeve 47 to adjust the length of the flexible strap 35 to fit differently sized arms 16. The second end 24 functions similar to a slip knot or cinch strap to snug the second end about the paper roll holder's arms 16.

Referring now to FIG. 8C, the second end 24 includes a plurality of evenly spaced holes 51 in the flexible strap 35, and a post 53 attached to the body portion 46 of the hanging member 20 for insertion into one of the holes. The post 53 can include a tapered catch 55 extending perpendicular from the top of the post to prevent the flexible strap 35 from coming off of the post. The circumference of the loop 45 can be changed by selecting different holes to insert the post 53 through when attaching the hanging member 20 to the arms 16 to fit differently sized arms.

Referring now to the hanging member 20 illustrated in FIG. 8D, the first end 22 contains a cutout 57 forming a leaf spring 59 on the bottom curved portion of the J-shaped body portion 46 of the hanging member 20. The leaf spring 59 can be made from a flexible or elastic material and can act as a bumper or a shock absorber in the event that the sheet-material dispenser 10 would swing away from the wall the paper roll holder 14 is secured to during dispensing, and then swing back towards the wall in a pendulum motion inadvertently striking the wall. The leaf spring 59, being flexible, would dampen or reduce the noise produced at any potential impact and help to prevent scratching or damaging the finish on the wall. Other means for absorbing impact of the sheet-material dispenser 10 can include a bumper located on either the sheet-material dispenser's bottom 26 or the hanging member 20, and a foam or elastomeric material located on either the sheet-material dispenser's bottom 26 or the hanging member 20. For example, an elastomeric material could be placed around the bottom perimeter of the sheet-material dispenser 10 to absorb impact energy and to reduce sliding or movement of the sheet-material dispenser when resting on a surface instead of hanging. If foam is used, it could be thick enough such it fills any gap between the wall and the sheet-material dispenser's bottom 26 where the foam is located when the sheet-material dispenser is hung from the paper roll holder 14. The foam could be provided with adhesive on both sides to stick the sheet-material dispenser's bottom 26 to the wall if desired to further reducing swinging and/or banging during use.

In this embodiment, the hanging member 20 is a universal hanging member such that it can fit and be used on either side of the sheet-material dispenser 10 by engaging either slot 34. To facilitate use on either side of the sheet-material dispenser, a pair of ears 68 separated by a gap 69 located on both sides of the body portion 46 of the hanging member 20 are provided. Each pair of ears 68 is adapted to receive a pair of protrusions 70 located on either side of a tab 41 connected to one end of an elastomeric strap 38 with the other end connected to the body portion 46. In use, the first end 22 of the hanging member 20 is inserted into one of the slots 34 located on the sheet-material dispenser's bottom 26. If the hanging member is inserted into the right-hand slot (as viewed from the sheet-material dispenser's front), then tab 41 is threaded up the inside of the paper roll holder's right arm 16 and wrapped over the arm, the elastomeric strap is then placed into the gap 69 and the protrusions 70 are placed into the ears 68 located on the right-hand side of the body portion 46 to secure the tab 41, forming the loop 45 and securing the hanging member 20 to the arm 16. If the hanging member is inserted into the left-hand slot (as viewed from the sheet-material dispenser's front), then tab 41 is threaded up the inside of the paper roll holder's left arm 16 and wrapped over the arm, the elastomeric strap is then placed into the gap 69 and the protrusions 70 are placed into the ears 68 located on the left-hand side of the body portion 46 to secure the tab 41 and forming the loop 45 securing the hanging member 20 to the arm 16. As such, the hanging member 20 is a universal design since it can be used in either slot 34 located on the bottom 26 of the sheet-material dispenser, and the elastomeric strap 38 can be secured to either side of the body portion 46.

Figure 8E:
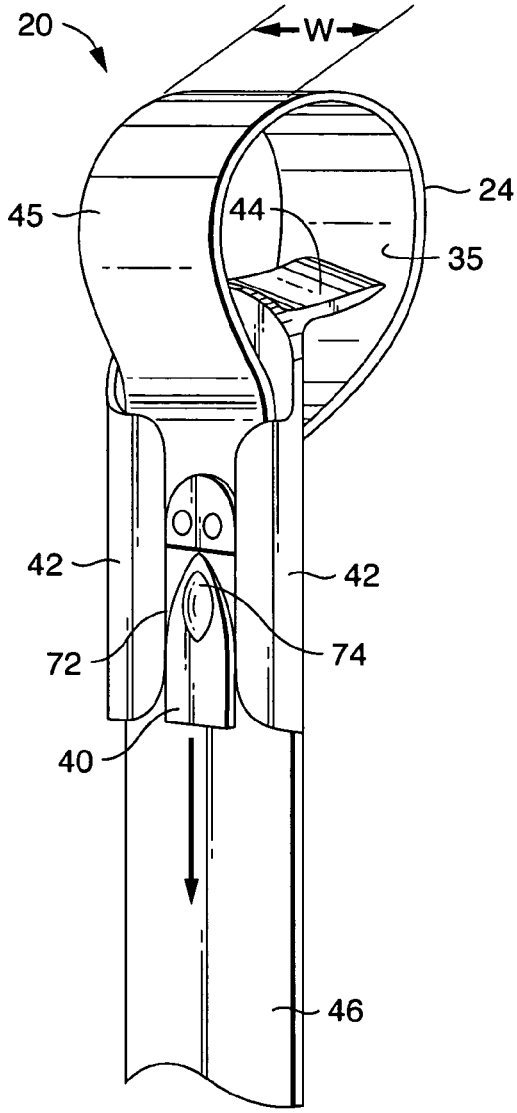

Referring now to FIG. 8E, the second end 24 includes a sliding button 40 attached to a flexible strap 35 that engages a receiving channel 42 located on the body portion 46. The sliding button 40 and the receiving channel 42 are provided with a ratcheting mechanism 72 such that the sliding button may be advanced in only one direction that tightens the loop 45 and then stays in position after adjustment. Thus, the circumference of the loop 45 can be reduced by moving the sliding button 40 in the direction indicated by the arrow, and the sliding button will stay in position until a release 74 on the sliding button is depressed, thereby disengaging the ratcheting mechanism 72 and allowing the sliding button to be retracted in a direction opposite to the arrow.

Thus, in various embodiment of the invention, the hanging member 20 can be provided with a means for removably attaching the second end 22 to at least one arm 16 of a paper roll holder 14 as discussed within the specification and illustrated in the Figures. Additional means for removably attaching the second end 22 to at least one arm 16 of a paper roll holder 14 can include hooks located on the second end, tying the second end to the arm by using a cord or string, or adhesively attaching the second end to the arm with non-permanent adhesive.

Figure 6:
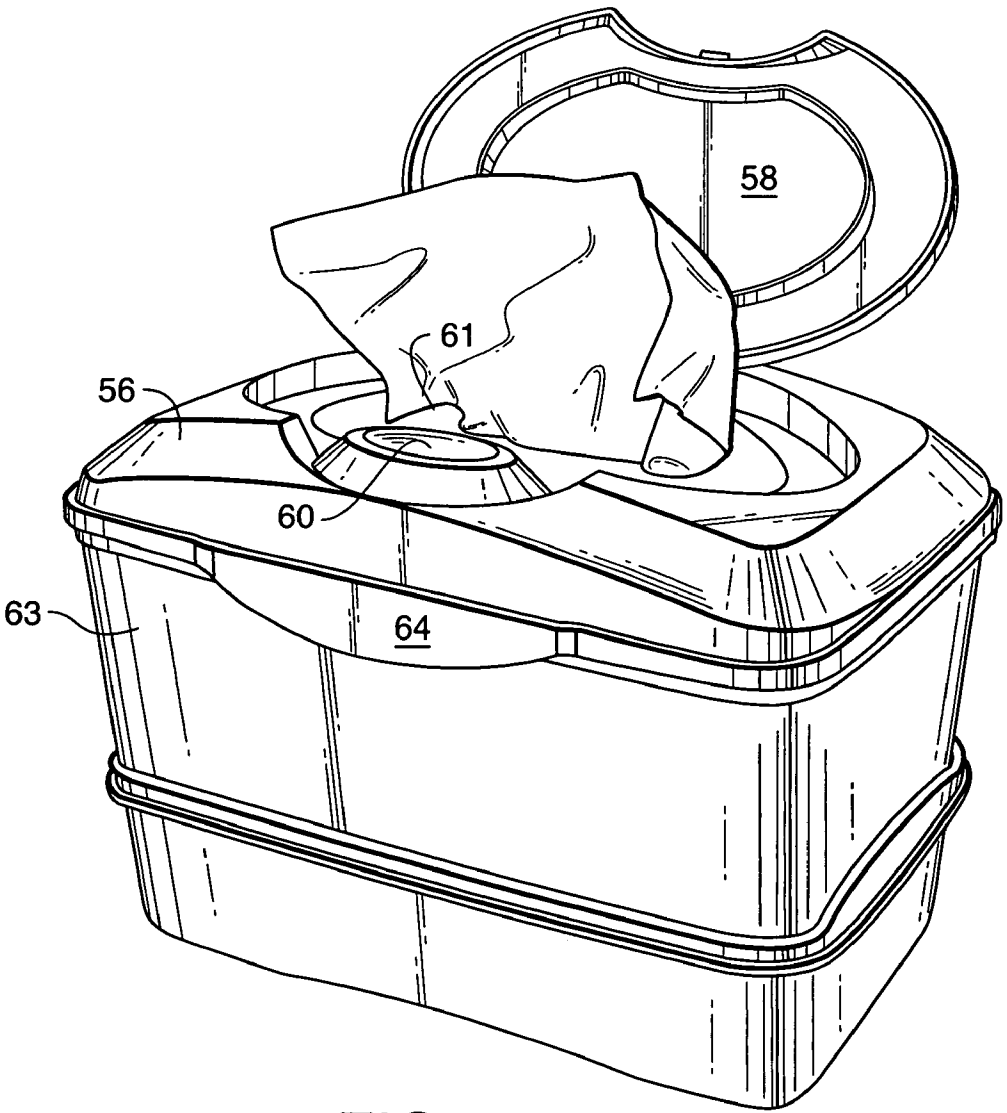
FIG. 6 is a perspective view of the sheet-material dispenser and tray for use on a flat surface or as packaged for merchandising.
Figure 7:
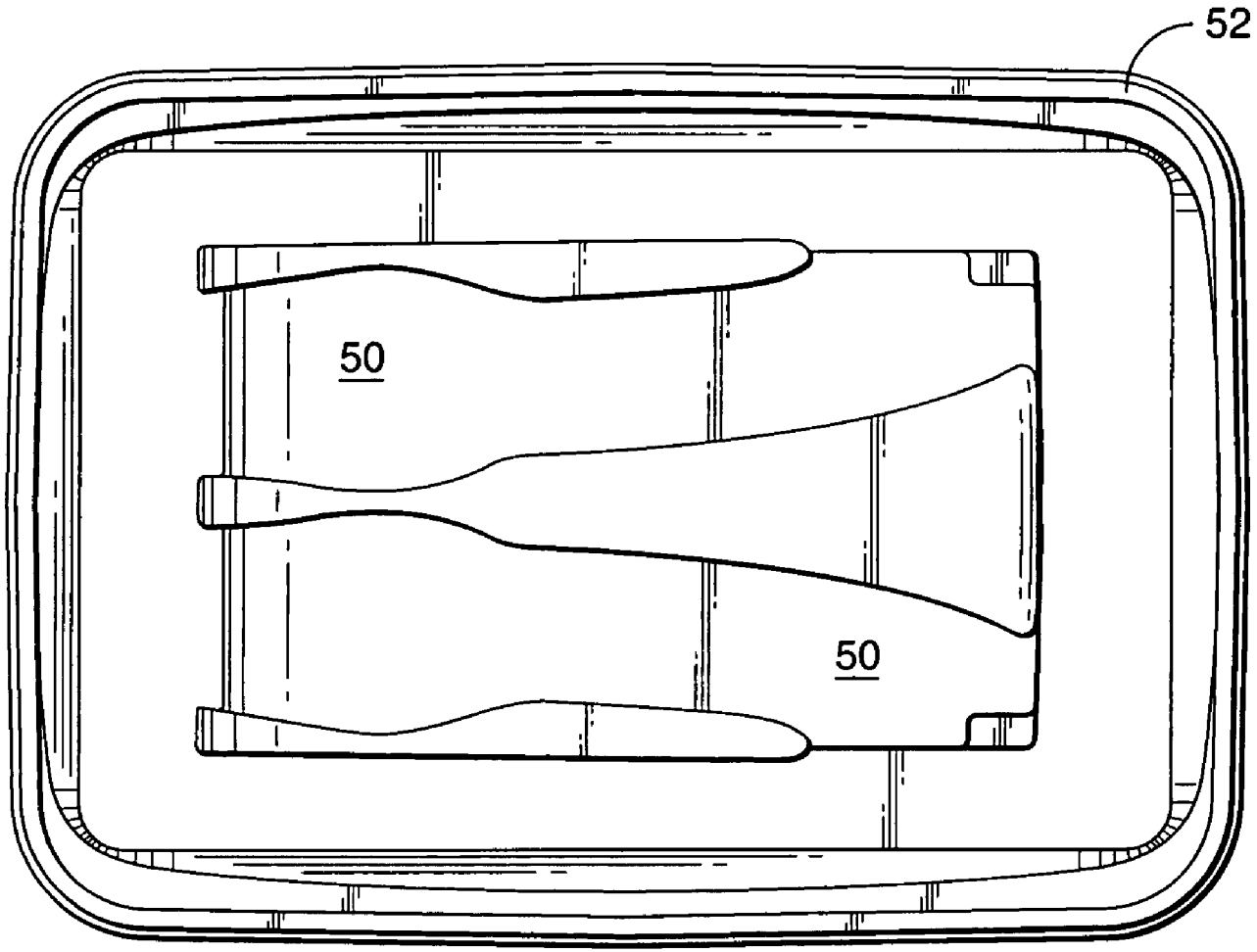
FIG. 7 is a top view illustrating the interior of the tray.

Referring now to FIGS. 5, 6, and 7, a removable tray 48 can be attached to the sheet-material dispenser's bottom 26. The tray 48 can be sold with the sheet-material dispenser 10 and can include a pair of hanging members 20 such as a right-hand and a left-hand hanging member (21, 23) that are initially not attached to the sheet-material dispenser 10. The tray 48 can be thermoformed and include recessed areas 50 in which the hanging members can rest or snap into. The tray 48 can include a flange 52 that engages with the sheet-material dispenser's bottom 26 and sidewall 27 to removably attach the tray 48 underneath the sheet-material dispenser 10. The sheet-material dispenser 10 can be used either with the tray 48 attached (FIG. 6) or with the tray 48 removed such that the sheet-material dispenser's bottom 26 rests on the counter. Typically, the tray 48 will be attached to the sheet-material dispenser 10 when sold and then removed by the user to either hang the sheet-material dispenser or to use the sheet-material dispenser on a counter. The sheet-material dispenser's bottom 26 or a portion thereof such as a ¼ inch wide strip around the perimeter of the bottom can be an anti-slip, foam, or elastomeric material to reduce movement of the sheet-material dispenser on surfaces or to reduce any impact of the sheet-material dispenser with a wall when hanging.

The hanging member 20 can be used with many different kinds of sheet-material dispensers 10, but desirably the sheet-material dispenser is designed to house a plurality of individual sheets that are pre-moistened with a cleansing solution to function as wet wipes. Referring now to FIGS. 1, 2, 5, and 6, the sheet-material dispenser 10 can include a top 54, the bottom 26, and the sidewall 27. Desirably, the top 54 includes a main-lid 56, a mini-lid 58, a push button 60, and a dispensing orifice 61. The sidewall 27 and the bottom 26 form a lower tub 63 of the sheet-material dispenser 10. The main-lid 56 can be hingably attached to the sidewall 27 by a pair of hinges 62. The main-lid 56 is secured in the closed position by a latch 64. When the latch 64 is unfastened, the main-lid 56 can be opened to expose the entire top of the tub 63 to replenish the sheet-material dispenser 10 with new wet wipes. The sheet-material dispenser 10 can be refilled without having to remove the sheet-material dispenser 10 from the paper roll holder 12 since the main-lid 56 is hinged away from the paper roll 14 and rotates downward or away from the paper roll 14, improving access to the sheet-material dispenser's interior. Alternatively, the sheet-material dispenser can be removed from the hanging members 20 to refill leaving the hanging members attached to the paper roll holder 14, or the entire assembly can be removed from the paper roll holder 12 by unfastening the elastomeric straps 38.

To dispense a wet wipe from the sheet-material dispenser 10, the push button 60 is depressed and a biasing spring rotates the mini-lid 58 to an open position, thereby exposing an exposed portion of the wet wipe. The rear edge of the mini-lid 58 can includes a pair of posts or projections that mate with a pair of apertures in the main-lid 56 for rotational movement. Desirably, the sheets forming the wet wipes are folded, perforated, interfolded, or interrelated such that withdrawing one wipe partially withdraws a portion of the next sheet. Desirably, the mini-lid 58 rotates downward or away from the paper roll 14, such that the exposed portion of the wet wipe is above the mini-lid 58 when the mini-lid is in the open position with the sheet-material dispenser 10 hanging from the paper roll holder 12 as best seen in FIG. 2. By having the mini-lid 58 rotate down and away from the main-lid 56, it is less likely to interfere with withdrawing the wet wipe and makes it easier to find and grab the exposed portion of the wet wipe.

The sheet-material dispenser 10 can be co-molded from two different materials such as a hard plastic and a softer TPE material. As such, sealing areas between the main-lid 56 and tub 63, and/or between the mini-lid 58 and main-lid 56 can have a gasket formed by the TPE material if desired to enhance moisture retention of the sheet-material dispenser 10. The hanging member 20 can also be co-molded with the body portion 46 and the sliding button 40 being molded in a hard plastic and the elastomeric strap 38, the upper surface of the anti-rotation stop 44, and the leaf spring 59 molded from the TPE material. The push button 60 can be co-molded with the sides of the push button formed from TPE material for easier use.

The dispensing orifice 61 can be formed as a slit in a dispensing panel 66 located beneath the mini-lid 58 that is formed from flexible or elastic material. The narrow slit in the dispensing panel 66 can help to retain moisture in the sheet-material dispenser 10, securely hold the exposed portion of the wet wipe in place and make it easier to reach into the sheet-material dispenser to retrieve the next wipe should the pop-up functionality fail since the elastomeric or flexible material can be readily deformed and then spring back into shape.

Suitable materials for forming the dispensing panel are disclosed in U.S. Pat. Nos. 6,766,919; 6,592,004; and 6,523,690. The dispensing panel 66 can be a flexible rubber-like sheet, the relevant material properties can be described in terms of the hardness, stiffness, thickness, elasticity, specific gravity, compression set, and any combination thereof. More specifically, the Shore A hardness (as measured by ASTM D2240) of the flexible, rubber-like sheet or material can be about 100 or less, more specifically from about 20 to about 90, and still more specifically from about 40 to about 80, and yet more specifically from about 60 to about 70 Shore A. The Gurley stiffness of the flexible, rubber-like sheet or material (as measured by ASTM D 6125-97 "Standard Test Method for Bending Resistance of Paper and Paperboard") can be about 10,000 milligrams of force (mgf) or less, more specifically from about 100 to about 8000 mgf, more specifically from about 200 to about 6500 mgf, and still more specifically from about 300 to about 1500 mgf. The thickness of the flexible, rubber-like sheet can be about 10 mil or greater, more specifically from about 10 mil to about 110 mil, and still more specifically from about 35 mil to about 60 mil. The elasticity of the flexible rubber-like material or sheet, as characterized by the tensile stress at 100 percent elongation and measured in accordance with ASTM D412 "Standard Test Methods for Vulcanized Rubber and Thermoplastic Elastomers", can be about 10 megapascals (MPa) or less, more specifically from about 0.1 to about 7 MPa, and still more specifically from about 0.5 to about 2.5 MPa. The flexible rubber-like sheet can have a specific gravity (per ASTM D792) of about 0.80 to 1.21, more specifically 0.88 to about 1.10, and still more specifically from about 0.90 to about 1.0. The flexible rubber-like sheet can have a compression set (per ASTM 395B) of (at room temperature/at 70 degrees C.) about $8/30$ to $40/120$ and more specifically $15/45$ to about $28/100$.

An example of suitable dispensing panel materials include thermoplastic elastomeric (TPE) materials that can be used to provide acceptable dispensing. Materials which can be employed include (but are not limited to): any of the family of styrenic-based TPE's (i.e. styrenic block copolymer compounds); styrenic-based TPE's containing rubber modifiers such as Kraton®, Santoprene®, or other rubber modifiers; Kraton®; Santoprene®; specialty copolymers, such as ethylene-methyl acrylate copolymers (e.g. EMAC® of the Eastman Chemical Company); thermoset rubbers; polyurethane; alloys; amides; engineering TPE's; olefinic-based; olefinic vulcanizates; polyester-based; polyurethane-based. One such material for the flexible dispensing panel could be that manufactured by the GLS-Corporation of McHenry, Ill., USA and known as resin #G2701. The G2701 material is one of the resins in the product family of TPEs. G2701 is a styrenic-based material and is in the family of Styrenic block copolymer compounds. Some particular properties of the G2701 can be: specific gravity of 0.090 g/cc (per ASTM D792); hardness (Shore A durometer) of 68 (ASTM D2240); and compression set of 24% at room temperature, 96% at 70 deg. C. (per ASTM 395B). Another similar material is known as G2755 and also sold by GLS Corporation. In addition, a lubricant (e.g., wax) can be added to lower the coefficient of friction of the continuous slit which can benefit injection molding, wet wipes dispensing, and physical handling of the flexible orifice. The G2701 TPE resin with ¼% wax additive sold by GLS Corporation and known as #LC217-189 can be used. Since the above materials are flexible and rubber-like, they can be suitable for forming the flexible strap 35 to make the loop 45 in the embodiments illustrated in FIGS. 8A, 8B, 8C, and 8E.

The hanging member 20 in the preceding embodiments has been shown in combination with a sheet-material dispenser 10 and intended for wet wipes and co-located beneath a dry toilet paper roll. However, the sheet-material dispenser 10 and the hanging member 20 can be used in combination with a paper towel holder for kitchen applications. Attachment to other paper roll holders is also contemplated such as holders for shop towels. Alternatively, the sheet-material dispenser 10 can be used with another sheet-material instead of wet wipes, or the hanging member 20 can be used to support an auxiliary dry paper roll by attaching two hanging members to a second spindle.

Other modifications and variations to the present invention may be practiced by those of ordinary skill in the art without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A product for hanging from a paper roll holder comprising at least one arm, the product comprising a sheet-material dispenser and at least one hanging member for attaching the sheet-material dispenser to the at least one arm, the hanging member forming a loop about the at least one arm to hold the sheet-material dispenser, wherein a length of the hanging member is adjustable so that a circumference of the loop may be varied;

wherein the hanging member has a first end, a second end, and a body portion and wherein the loop is formed from a strap that is removably attachable to the body portion;

wherein the second end comprises an elastomeric strap forming the loop; and wherein the second end comprises a sliding button attached to one end of the elastomeric strap and a receiving channel attached to the body portion of the hanging member for engaging with the sliding button to secure the sliding button in the receiving channel forming the loop in the elastomeric strap.

2. The product of claim 1 wherein the hanging member has a first end, a second end, and a body portion, and wherein the first end is removably attachable to the sheet-material dispenser.

3. The product of claim 2 wherein the first end comprises a tongue and a locking tab.

4. The product of claim 3 wherein the locking tab comprises a projection.

5. The product of claim 3 wherein the sheet-material dispenser comprises a bottom and the bottom comprises a slot for receiving the tongue.

6. The product of claim 4 wherein the sheet-material dispenser comprises a bottom and the bottom comprises a slot for receiving the tongue and an aperture for receiving the projection on the locking tab.

7. The product of claim 3 wherein the first end comprises a cutout in a body portion of the hanging member forming a leaf spring.

8. The product of claim 1 wherein the second end comprises a sliding button attached to the strap and a receiving channel located on the body portion securing the sliding button in the channel forming the loop the strap and a ratcheting mechanism for indexing the sliding button in the receiving channel in one direction unless a release located on the sliding button is depressed.

9. The product of claim 1 wherein the hanging member has a first end, a second end, and a body portion, the first end is removably attachable to the sheet-material dispenser, and a circumference of the loop is adjustable.

10. The product of claim 9 wherein the first end comprises a tongue and a locking tab.

11. The product of claim 9 wherein the second end comprises an elastomeric strap forming the loop.

12. The product of claim 10 wherein the second end comprises an elastomeric strap forming the loop.

13. The product of claim 11 wherein the second end comprises a sliding button attached to one end of the elastomeric strap and a receiving flange on the body portion for engaging with the sliding button to secure the sliding button forming the loop in the elastomeric strap.

14. The product of claim 12 wherein the second end comprises a sliding button attached to one end of the elastomeric strap and a receiving flange for engaging with the sliding button located on the body portion to secure the sliding button forming the loop in the elastomeric strap.

15. The product of claim 1 wherein the hanging member comprises a first end, a second end, and a body portion, and the body portion is J-shaped such that the first end and the second end are offset from each other.

16. The product of claim 1 wherein the second end comprises an anti-rotation stop extending perpendicular to the body portion which brings more surface area of the second end into contact with the arm.

17. The product of claim 16 wherein the upper surface of the anti-rotation stop that contacts the arm comprises a thermoplastic elastomer.

* * * * *